US010850312B2

(12) United States Patent
Rechlin

(10) Patent No.: US 10,850,312 B2
(45) Date of Patent: Dec. 1, 2020

(54) DRAIN LINE CLEANING DEVICE AND KIT

(71) Applicant: Neil Rechlin, Davenport, FL (US)

(72) Inventor: Neil Rechlin, Davenport, FL (US)

( * ) Notice: Subject to any disclaimer, the term of this patent is extended or adjusted under 35 U.S.C. 154(b) by 0 days.

(21) Appl. No.: 16/224,726

(22) Filed: Dec. 18, 2018

(65) Prior Publication Data

US 2020/0254495 A1 Aug. 13, 2020

Related U.S. Application Data

(63) Continuation-in-part of application No. 15/893,356, filed on Feb. 9, 2018.

(51) Int. Cl.
*B08B 9/032* (2006.01)
*F24F 13/22* (2006.01)

(52) U.S. Cl.
CPC ..... *B08B 9/0321* (2013.01); *F24F 13/222* (2013.01); *F24F 2013/227* (2013.01); *F24F 2221/225* (2013.01)

(58) Field of Classification Search
CPC . B08B 9/0321; F24F 13/222; F24F 2013/227; F24F 2221/225
See application file for complete search history.

(56) References Cited

U.S. PATENT DOCUMENTS 2,215,132 A * 9/1940 Parker ..... B05B 7/30 417/181
2,568,515 A * 9/1951 Scheiwer ..... B05B 1/14 239/289
4,194,765 A * 3/1980 Reddy ..... F16L 37/04 285/27
4,460,019 A * 7/1984 Condon ..... E03F 7/00 138/90
5,421,904 A * 6/1995 Carlson ..... B08B 9/0321 134/167 C
6,006,766 A * 12/1999 Soulages ..... E03F 9/00 134/166 C
6,311,501 B1 * 11/2001 Allison ..... F25C 1/12 62/303
6,701,740 B1 * 3/2004 Hernandez-Zelaya ..... F24F 13/222 137/625.47
7,624,756 B1 * 12/2009 Coogle ..... F24F 13/222 137/240
8,752,865 B1 * 6/2014 Coogle ..... F24F 13/222 137/240
2015/0059868 A1 * 3/2015 Oakner ..... F24F 13/02 137/240

* cited by examiner

*Primary Examiner* — Benjamin L Osterhout
(74) *Attorney, Agent, or Firm* — Cygnet IP Law, P.A.; Stephen W. Aycock, II

(57) ABSTRACT

A drain line cleaning device and kit are described.

5 Claims, 5 Drawing Sheets

DRAIN LINE CLEANING DEVICE AND KIT

This application is a continuation-in-part of application Ser. No. 15/893,356, filed on Feb. 9, 2018.

Embodiments relate generally to drain line cleaning devices and more particularly to a device and kit for cleaning air conditioner condensate drain lines.

Condensate drain lines can often be difficult to clean due to the location of air handlers (e.g., in an attic) and limited accessibility to the condensate drain line at or near the source of condensate (e.g., the air handler).

Embodiments were conceived in light of the above-mentioned problems and limitations, among other things.

DETAILED DESCRIPTION

Figure 1:
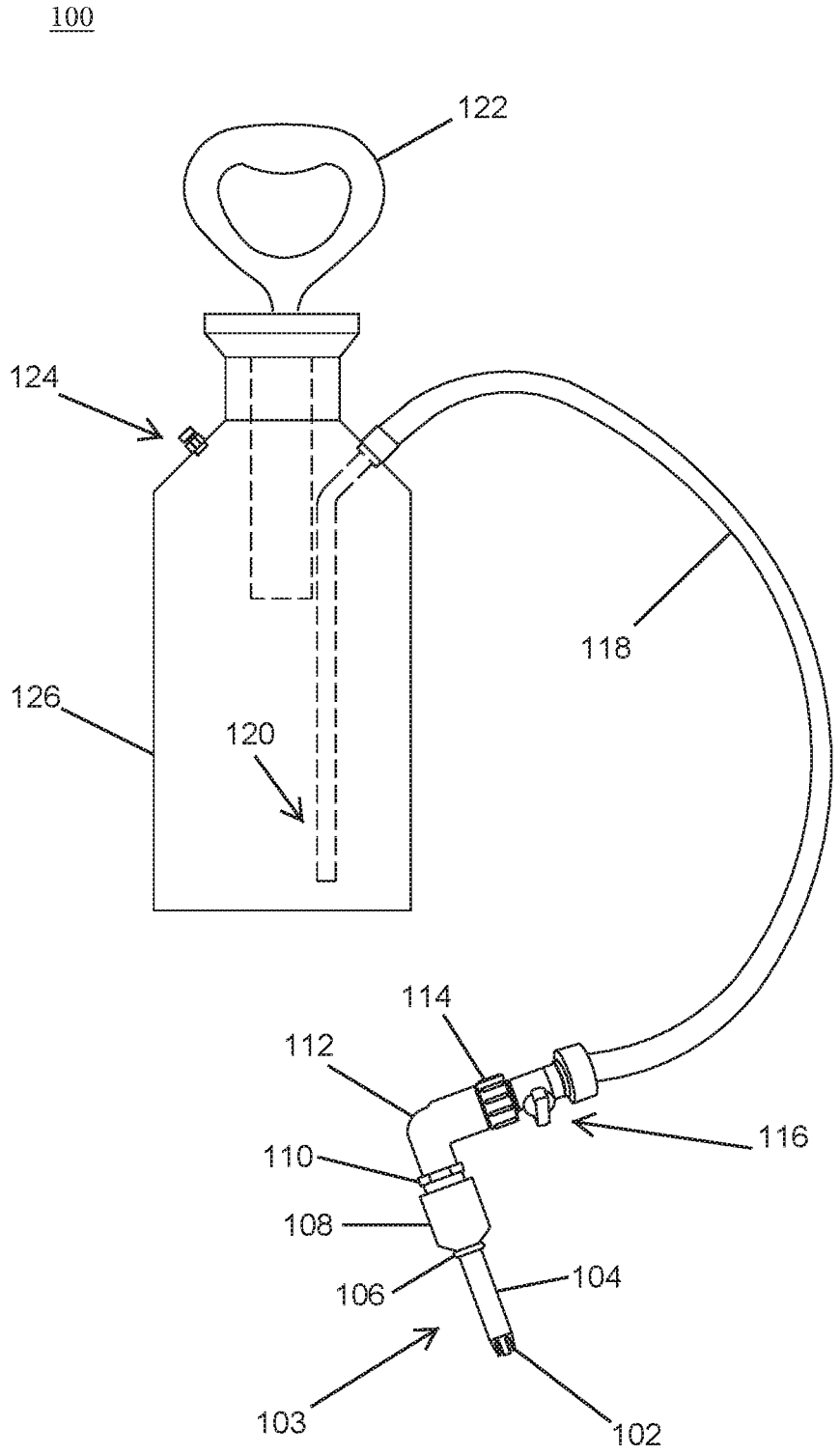
FIG. 1 shows a side elevation view of a drain cleaning device in accordance with some implementations.

FIG. 1 shows a side elevation view of a drain cleaning device 100 in accordance with some implementations. The drain line cleaning device 100 includes a removable lower section 103 that includes a tapered end 102 that includes apertures forming a serrated edge that can be used to remove excess glue within a drain line by rotating the tapered end 102 within a pipe. The removable lower section 103 also includes a lower portion 104 that is constructed to be inserted within an interior of a condensate drain line. The removable lower section 103 also includes an optional elastomeric gasket 106 to help seal the removable lower section 103 to a condensate drain line. The removable lower section 103 further includes a fluted opening 108 that is operable to connect to a corresponding element 110 on the drain line cleaning device 100 or operable to serve as a funnel for pouring a cleaning solution (e.g., bleach) into a condensate drain line.

The drain line cleaning device 100 include an angled connector 112 (e.g., a 90 degree connector), a threaded coupler 114, a valve 116, a hose 118, an internal line 120, a pump 122, a pressure relief valve 124, and a tank body 126.

Figure 2:
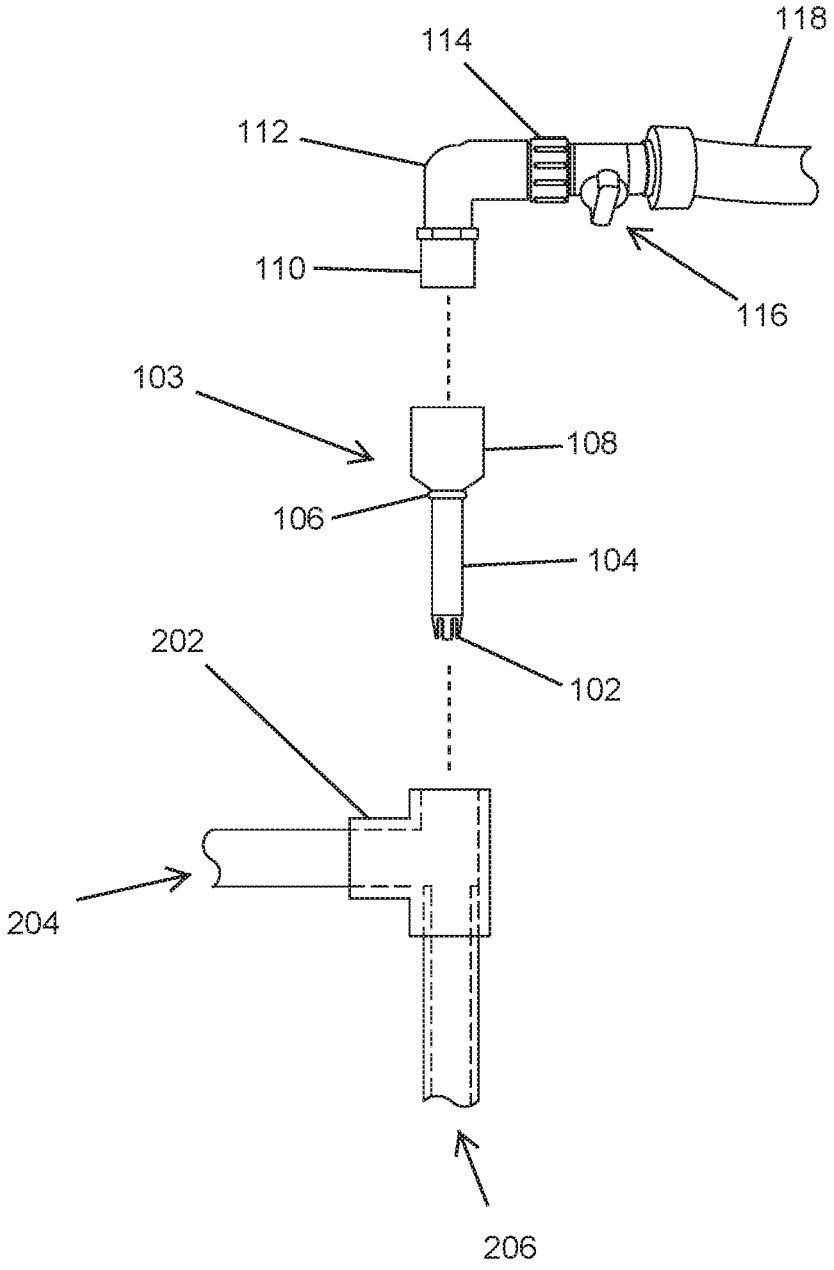
FIG. 2 shows an exploded view of an example condensate drain line cleaning device end section in accordance with some implementations.

As shown in FIG. 2, the drain line cleaning device 100 is constructed to be inserted into a plumbing connector (e.g., tee 202). In FIG. 2, the plumbing connector 202 connects a condensate line 204 coming from a source of condensate (or other fluid) such as an air handler to a drain line 206 that carries the condensate to a drainage area (e.g., outside of a building or into a sewage line, etc.).

The drain cleaning device 100 lower portion 104 is inserted (e.g., via an interference fit) into an opening of the drain line 206 via connector 202.

In operation, air and fluid in the tank 126 is pressurized via the pump 122. When the valve 116 is opened, fluid from the tank 126 flows under the urging of the pressure within the tank 126 out the interior line 120 and through the hose 118 to the lower portion 103 to supply fluid (e.g., water, air, or cleaning fluid such as a bleach solution) to help clean and clear the drain line 206 of buildup (e.g., mold, slime, etc.) or debris, while preventing the fluid from flowing back into condensate line 204.

FIG. 2 shows an exploded view of a condensate drain line cleaning device 100 in accordance with some implementations. FIG. 2 shows the condensate line 204 from the equipment (e.g., air handler) connected to a fitting 202 (e.g., a tee) an on to the drain line 206.

Figure 3:
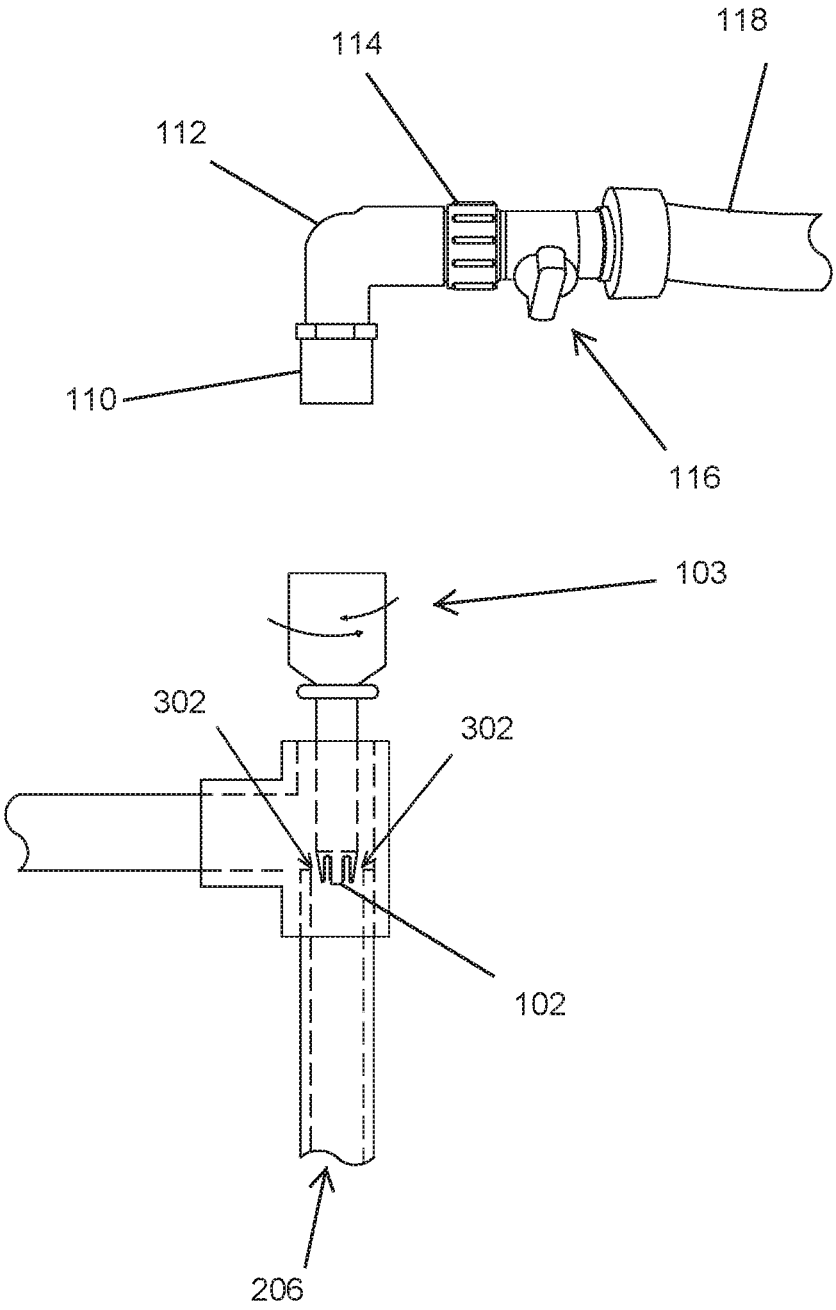
FIG. 3 shows a side elevation view of an example drain cleaning device being inserted into a drain line in accordance with some implementations.

FIG. 3 shows a close up view of the lower portion 103 being twisted within the drain line 206 to cause the tapered end 102 to help remove excess adhesive 302 when the lower portion 103 is rotated within the drain line 206.

Figure 4:
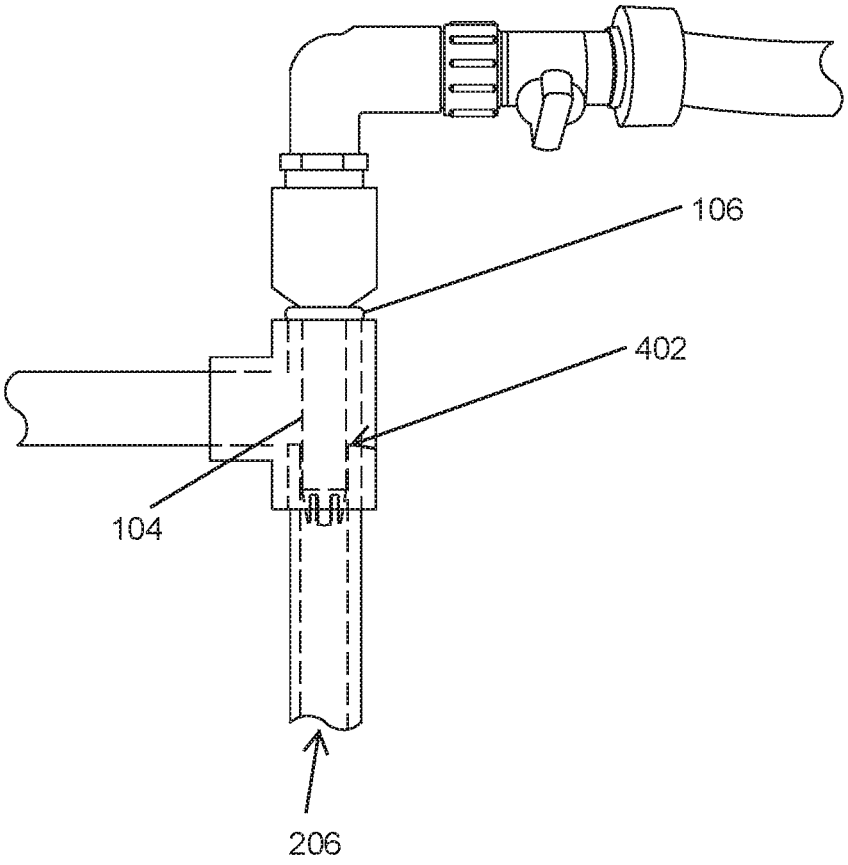
FIG. 4 shows a side elevation view of an example drain cleaning device inserted into a drain line in accordance with some implementations.

FIG. 4 shows the lower portion 103 inserted into the drain line 206 such that the tapered end 104 engages the top of the drain line 402 in an interference fit and the elastomeric seal 106 engages the top of the fixture 202 to help provide a seal to prevent cleaning fluid from leaking from the drain line cleaning device when in use cleaning a drain line 206.

In operation, fluid (e.g., water, cleaning solution such as a bleach solution, etc.) can be sprayed into the drain line 206 by the pressurized tank 126.

Figure 5:
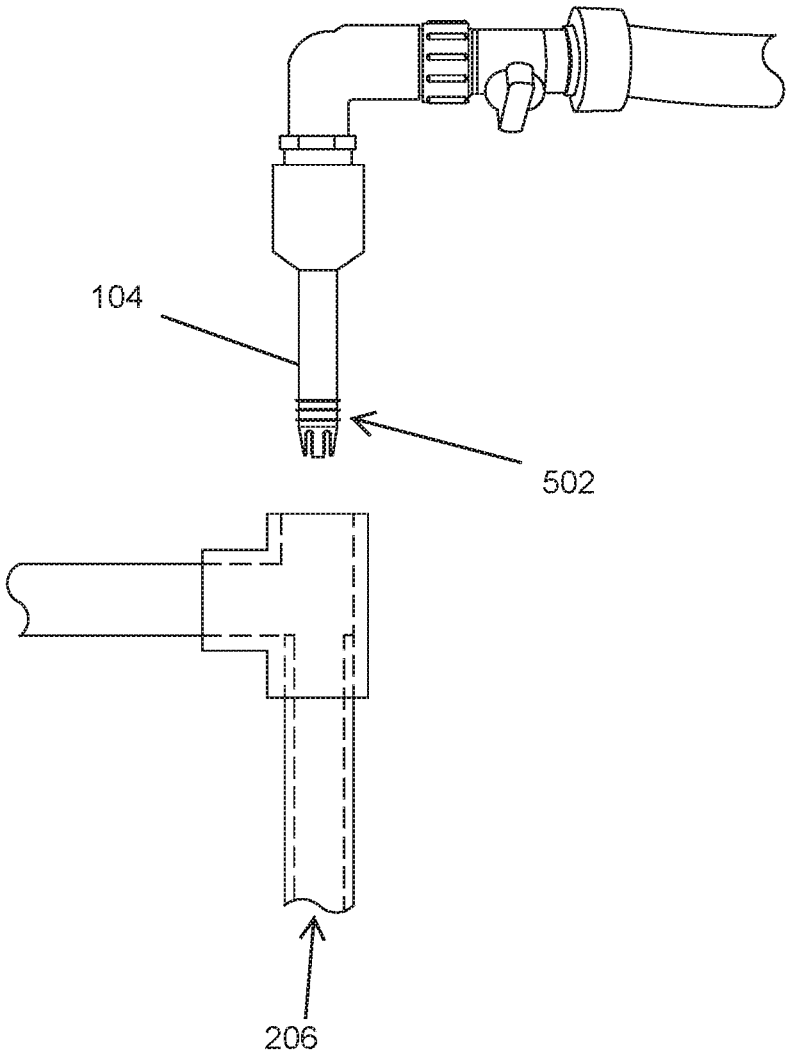
FIG. 5 shows a side elevation view of an example drain cleaning device with flexible baffles in accordance with some implementations.

FIG. 5 shows an example tapered end 104 having one or more flexible baffles 502 that are operable to engage the inside wall of a drain line (e.g., 206) and help create a seal to prevent cleaning fluid from escaping around the tapered end 104.

It is, therefore, apparent that there is provided in accordance with the presently disclosed subject matter, a drain line cleaning device and kit. While this disclosed subject matter has been described in conjunction with a number of embodiments, it is evident that many alternatives, modifications and variations would be or are apparent to those of ordinary skill in the applicable arts. Accordingly, applicant intends to embrace all such alternatives, modifications, equivalents and variations that are within the spirit and scope of the disclosed subject matter.

What is claimed is:

1. A drain line cleaning device comprising:

a tank;

a pump operable to pressurize air inside the tank;

an interior line connected to an exterior hose;

a valve connected to a distal end of the hose;

an angled member connecting the valve to a fitting configured to connect with a tapered lower portion, wherein the tapered lower portion is configured to fit within a plumbing connection and engage via an interference fit an opening of a pipe inserted into the plumbing connection, and wherein the tapered lower portion includes an end having one or more cut out sections configured to remove glue from an interior of a drain line.

2. The drain line cleaning device of claim 1, wherein the tapered lower portion includes one or more flexible baffles configured to engage a sidewall of the drain line.

3. The drain line cleaning device of claim 1, wherein the fitting configured to connect with the tapered lower portion is removable.

4. The drain line cleaning device of claim 1, wherein the fitting configured to connect with the tapered lower portion includes a fluted opening to connect to a corresponding element on the drain cleaning device to serve as a funnel for pouring a solution into a plumbing line.

5. The drain line cleaning device of claim 1, wherein the fitting configured to connect with the tapered lower portion is rotatable within the drain line.

* * * * *